US010914307B1

(12) United States Patent
Tu

(10) Patent No.: US 10,914,307 B1
(45) Date of Patent: Feb. 9, 2021

(54) CIRCUIT ASSEMBLY FOR A SUBMERSIBLE PUMP AND SUBMERSIBLE PUMP USING THE SAME

(71) Applicant: Zhushi Tu, Hubei (CN)

(72) Inventor: Zhushi Tu, Hubei (CN)

( * ) Notice: Subject to any disclaimer, the term of this patent is extended or adjusted under 35 U.S.C. 154(b) by 0 days.

(21) Appl. No.: 16/862,660

(22) Filed: Apr. 30, 2020

Related U.S. Application Data

(63) Continuation-in-part of application No. 16/726,129, filed on Dec. 23, 2019.

(30) Foreign Application Priority Data

Jul. 15, 2019 (CN) ..... 2019 2 1104262 U

(51) Int. Cl.
*F04D 15/00* (2006.01)
*F04D 13/08* (2006.01)
*F04B 49/06* (2006.01)

(52) U.S. Cl.
CPC ..... *F04D 13/086* (2013.01); *F04B 49/06* (2013.01)

(58) Field of Classification Search
CPC ..... F04B 49/06; F04D 13/086
See application file for complete search history.

(56) References Cited

U.S. PATENT DOCUMENTS

2003/0129856 A1* 7/2003 Takizawa ..... H02K 3/50 439/13
2016/0310149 A1* 10/2016 Downey ..... A61B 5/0225
2017/0045055 A1* 2/2017 Hoefel ..... F04D 1/06

* cited by examiner

*Primary Examiner* — Muhammad S Islam

(57) ABSTRACT

A circuit assembly for a submersible pump and a submersible pump using the same is disclosed. The circuit assembly comprises: a signal generating circuit, which is configured to access a DC signal, and invert the DC signal into an AC signal having a frequency range of 40 Hz-200 Hz and then output the AC signal; and a driving circuit, which has an input terminal connected to the signal generating circuit and an output terminal connected to a stator coil of the submersible pump, and is configured to receive the AC signal and drive the stator coil to work. The submersible pump can directly access DC power supply, which is very convenient for the user; and further, a water shortage detecting circuit can be preferably configured to trigger the signal generating circuit to control the driving circuit stopping driving the stator coil when the liquid level is too low.

17 Claims, 14 Drawing Sheets

CIRCUIT ASSEMBLY FOR A SUBMERSIBLE PUMP AND SUBMERSIBLE PUMP USING THE SAME

CROSS-REFERENCE TO RELATED APPLICATIONS

The present application is a continuing-in-part application of a U.S. application Ser. No. 16/726,129 filed on Dec. 23, 2019, which claims the benefit of Chinese Patent Application No. 2019211042627 filed on Jul. 15, 2019. All the above are hereby incorporated by reference.

FIELD

The present application generally relates to submersible pumps, more particularly to a circuit assembly for a submersible pump and a submersible pump using the same.

BACKGROUND

At present, most submersible pumps are directly connected to AC (Alternating Current) power supply. This power supply method has low working efficiency, and the power supply belongs to an AC linear power supply. The technology is backward, cumbersome and difficult to purchase. In other water pumps which work with DC (Direct Current) power supply, mostly two sets of coils are wound in parallel and a Hall switch is used to switch the two sets of coils to work alternately, so that a pump rotor continues to rotate. But such structure is complicated, the cost is high, and a dead point is easy to occur, so that the pump cannot work properly, reducing user experience.

SUMMARY

The present application provides a circuit assembly for a submersible pump and a submersible pump using the same according to the aforementioned needs of the prior art.

According to one aspect of the present application, a circuit assembly for a submersible pump is provided, comprising: a signal generating circuit, which is configured to access a DC signal, and invert the DC signal into an AC signal having a frequency range of 40 Hz-200 Hz and then output the AC signal; and a driving circuit, which has an input terminal connected to the signal generating circuit and an output terminal connected to a stator coil of the submersible pump, and is configured to receive the AC signal and drive the stator coil to work.

In one embodiment, the signal generating circuit is composed of a 555 chip and its peripheral components, or is composed of a digital gate integrated chip and its peripheral components, or the signal generating circuit is composed of a triode and resistors, capacitors, or the signal generating circuit is composed of a MCU (Microcontroller Unit) and its peripheral components. In one embodiment, a model of the MCU is FT60F011A, and a power supply pin and a ground pin of the MCU are connected to a positive pole and a negative pole of a DC power supply which is filtered by an electrolytic capacitor respectively, and a Pin 4 of the MCU is connected to a first switch, Pin 6 and Pin 7 of the MCU are respectively connected to a first LED and a second LED, and Pin 2 and Pin 3 of the MCU are output pins of the AC signal. In one embodiment, capacity range of the electrolytic capacitor is 100 uF-2200 uF.

In one embodiment, the driving circuit is composed of a motor-specific driver chip and its peripheral components, or a MOSFET tube and its peripheral components, or a digital power amplifier chip and its peripheral components, or a triode and resistors, capacitors.

In one embodiment, the AC signal is a square wave signal, or a sine wave signal, or a modified sine wave signal, or a triangular wave signal, or a truncated sine wave signal, or a trapezoidal wave signal. In one embodiment, the frequency range of the AC signal is 40 Hz-80 Hz. In one embodiment, voltage range of the DC signal is 3V-24V.

In one embodiment, the circuit assembly further comprises a water shortage detecting circuit, which is connected to the signal generating circuit, and is configured to monitor liquid level based on a detection signal of a liquid level detecting probe, and trigger the signal generating circuit to control the driving circuit when the liquid level is detected to be lower than the liquid level detecting probe, causing the driving circuit stop supplying power to the stator coil, so that the submersible pump stops pumping. In one embodiment, the liquid level detecting probe is made of metal or carbon fiber. In one embodiment, the water shortage detecting circuit is composed of a liquid level detection chip of model HL-2205S and its peripheral components, or a MCU and its peripheral components, or a touch sensor chip and its peripheral components, or a triode and resistors, capacitors. In one embodiment, the liquid level detecting probe is welded on a circuit board or fixed on a circuit board with screws.

In one embodiment, the circuit assembly further comprises: a switching circuit, which is connected to the signal generating circuit, and is configured to acquire a switching signal input by a user and output the switching signal to the signal generating circuit, to trigger the signal generating circuit to control the driving circuit to change operating mode, or to control start or shutdown of the driving circuit; and a prompting circuit, which is connected to the signal generating circuit, and is configured to prompt working status of the submersible pump by controlling working status of a LED.

According to another aspect of the present application, a submersible pump is provided, comprising a circuit assembly, wherein the circuit assembly comprises: a signal generating circuit, which is configured to access a DC signal, and invert the DC signal into an AC signal having a frequency range of 40 Hz-200 Hz and then output the AC signal; and a driving circuit, which has an input terminal connected to the signal generating circuit and an output terminal connected to a stator coil of the submersible pump, and is configured to receive the AC signal and drive the stator coil to work.

In one embodiment, the frequency range of the AC signal is 40 Hz-80 Hz.

In one embodiment, the stator coil comprises a plastic frame, an enameled copper wire wound on the plastic frame, and a stator metal core inserted in the plastic frame that has been wrapped with the enameled copper wire. In one embodiment, wire diameter of the enameled copper wire is 0.1 mm-0.4 mm. In one embodiment, number of coil turns of the enameled copper wire wound on the plastic frame is 100-400 turns. In one embodiment, the enameled copper wire wound on the plastic frame is formed by winding one enameled copper wire or a plurality of enameled copper wires in parallel. In one embodiment, the stator metal core comprises a plurality of U-shaped metal sheets with a thickness of 0.3 mm-0.8 mm laminated together.

The circuit assembly for a submersible pump and the submersible pump using the same according to embodiments of the present application have the following beneficial effects: the submersible pump of the present application can directly access DC power supply, which is very convenient for the user; and further, the water shortage detecting circuit can be preferably configured to trigger the signal generating circuit to control the driving circuit stopping driving the stator coil when the liquid level is too low, so that water pumping is no longer continued, and a protection when the water level is too low is realized.

BRIEF DESCRIPTION OF THE DRAWINGS

In order to more clearly explain embodiments of the present application or technical solutions in the prior art, drawings used in the description of the embodiments or the prior art will be briefly introduced below. Obviously, the drawings in the following description are merely embodiments of the present application. For those of ordinary skill in the art, other drawings can be obtained according to the provided drawings without paying creative labor.

FIG. 0.7 is a schematic diagram of conversion of a DC signal into a trapezoidal wave signal;

DETAILED DESCRIPTION

Figure 1:
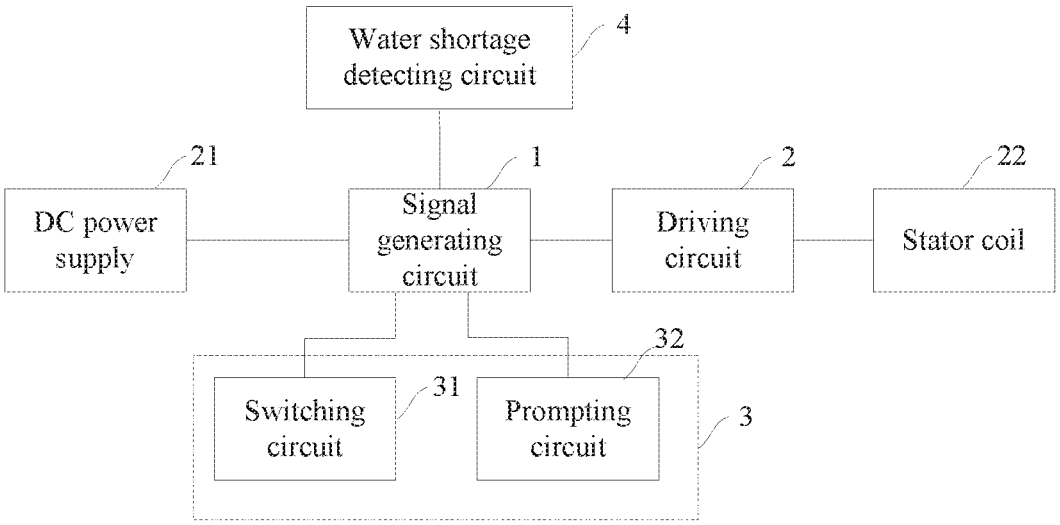
FIG. 1 is a circuit block diagram of a circuit assembly for a submersible pump of the present application.

In order to facilitate understanding of the present application, the present application will be described more fully hereinafter with reference to the accompanying drawings. Exemplary embodiments of the present application are shown in the drawings. However, the present application may be embodied in many different forms and is not limited to the embodiments described herein. Rather, these embodiments are provided for the purpose of making a disclosure of the present application more comprehensive. It should be understood that the specific features of the embodiments and the embodiments of the present application are the detailed description of the technical solutions of the present application, and are not intended to limit the technical solutions of the present application, in the case of no conflict, the embodiments of the present application and the technical features in the embodiments can be combined with each other.

It should be noted that "connected" or "connected to" as used herein includes not only directly connecting two entities, but also indirectly connecting through other entities having beneficial improvement effects.

All technical and scientific terms used herein have the same meaning as commonly understood by one of ordinary skill in the art to the application. The terminology used in the description of the present application is for a purpose of describing particular embodiments and is not intended to limit the application.

Referring to FIG. 1, a circuit block diagram of a circuit assembly for a submersible pump of the present application is shown. The circuit assembly for a submersible pump of the present application comprises a signal generating circuit 1 and a driving circuit 2. The signal generating circuit 1 is configured to access a DC signal from a DC power supply 21, and invert the DC signal into an AC signal and then output the AC signal. The AC signal has a frequency range of 40 Hz-200 Hz, and preferably the frequency range of the AC signal is 40 Hz-80 Hz. The driving circuit 2 has an input terminal connected to the signal generating circuit 1 and an output terminal connected to a stator coil of the submersible pump. The driving circuit 2 is configured to receive the AC signal and drive the stator coil to work.

Figure 2:
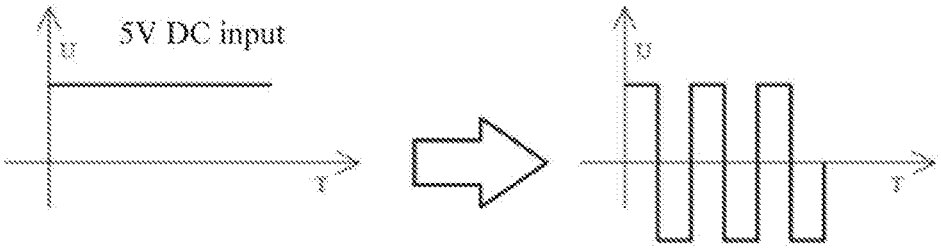
FIG. 2 is a schematic diagram of conversion of a DC signal into a square wave signal.
Figure 3:
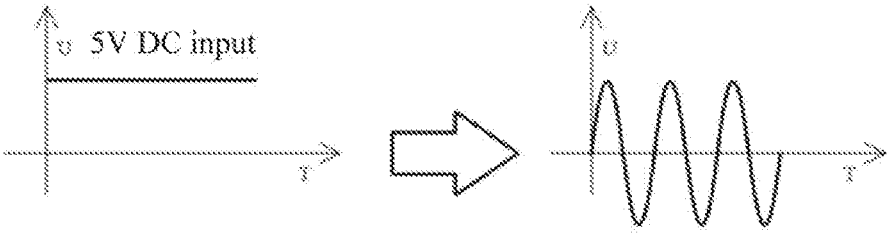
FIG. 3 is a schematic diagram of conversion of a DC signal into a sine wave signal.
Figure 4:
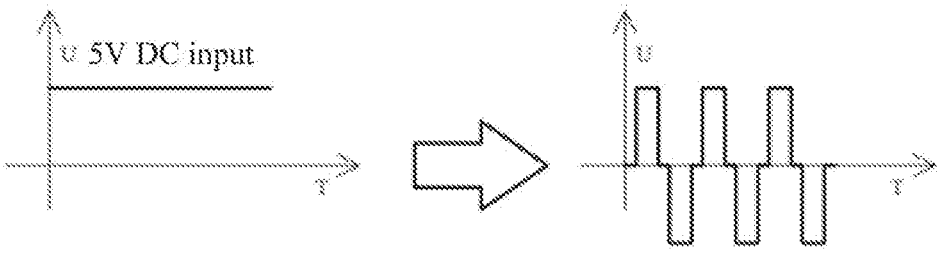
FIG. 4 is a schematic diagram of conversion of a DC signal into a modified sine wave signal.
Figure 5:
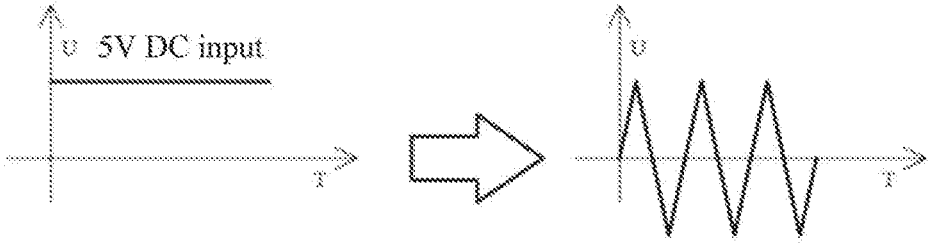
FIG. 5 is a schematic diagram of conversion of a DC signal into a triangular wave signal.
Figure 6:
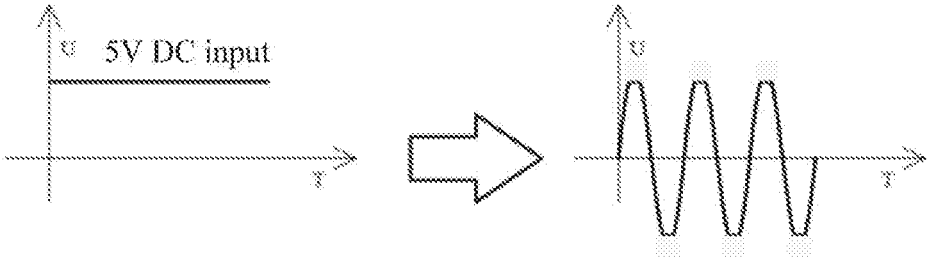
FIG. 6 is a schematic diagram of conversion of a DC signal into a truncated sine wave signal.
Figure 7:
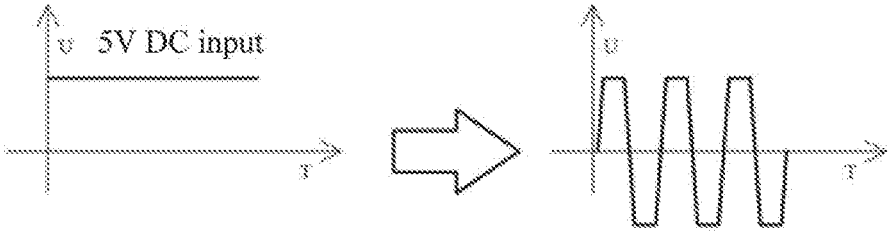

Specifically, voltage range of the DC signal is 3V-24V, preferably a 5V DC input is chosen. Referring to FIG. 2, the AC signal is a square wave signal. Referring to FIG. 3, the AC signal can be a sine wave signal. Referring to FIG. 4, the AC signal can also be a modified sine wave signal. Referring to FIG. 5, the AC signal can be a triangular wave signal. Referring to FIG. 6, the AC signal can also be a truncated sine wave signal. Referring to FIG. 7, the AC signal can also be a trapezoidal wave signal.

Specifically, the signal generating circuit 1 is composed of a 555 chip and its peripheral components, or is composed of a digital gate integrated chip and its peripheral components, or the signal generating circuit 1 is composed of a triode and resistors, capacitors, or the signal generating circuit 1 is composed of a MCU (Microcontroller Unit) and its peripheral components. According to embodiments of the present application, a model of the MCU is FT60F011A, and a power supply pin and a ground pin of the MCU are connected to a positive pole and a negative pole of a DC power supply which is filtered by an electrolytic capacitor respectively, and a Pin 4 of the MCU is connected to a first switch, Pin 6 and Pin 7 of the MCU are respectively connected to a first LED and a second LED, and Pin 2 and Pin 3 of the MCU are output pins of the AC signal. In one embodiment, capacity range of the electrolytic capacitor is 100 uF-2200 uF.

Specifically, the driving circuit 2 is composed of a motor-specific driver chip and its peripheral components, or a MOSFET tube and its peripheral components, or a digital power amplifier chip and its peripheral components, or a triode and resistors, capacitors.

Referring to FIG. 1 again, the circuit assembly further comprises a input and output circuit 3, and the input and output circuit 3 further comprises a switching circuit 31 and a prompting circuit 32. The switching circuit 31 is connected to the signal generating circuit 1, and is configured to acquire a switching signal input by a user and output the switching signal to the signal generating circuit 1, to trigger the signal generating circuit 1 to control the driving circuit 2 to change operating mode, or to control start or shutdown of the driving circuit 2. The prompting circuit 32 is connected to the signal generating circuit 1, and is configured to prompt working status of the submersible pump by controlling working status of a LED.

Referring to FIG. 1, the circuit assembly further comprises a water shortage detecting circuit 4 and a liquid level detecting probe. The liquid level detecting probe is made of metal or carbon fiber, and the liquid level detecting probe may be welded on a circuit board or fixed on a circuit board with screws. The water shortage detecting circuit 4 is connected to the liquid level detecting probe and the signal generating circuit 1 respectively, and is configured to monitor liquid level based on a detection signal of the liquid level detecting probe, and trigger the signal generating circuit 1 to control the driving circuit 2 when the liquid level is detected to be lower than the liquid level detecting probe, causing the driving circuit 2 stop supplying power to the stator coil 22, so that the submersible pump stops pumping.

Specifically, the water shortage detecting circuit 4 is composed of a liquid level detection chip and its peripheral components, or a MCU and its peripheral components, or a touch sensor chip and its peripheral components, or a triode and resistors, capacitors. A single MCU can be assigned to the water shortage detecting circuit 4, or it can share the same MCU with the signal generating circuit 1. In one embodiment, the water shortage detecting circuit is composed of a liquid level detection chip of model HL-22055 and its peripheral components, or a MCU and its peripheral components, or a touch sensor chip and its peripheral components, or a triode and resistors, capacitors.

The following are detailed description of some specific embodiments of the circuit assembly of the submersible pump.

Embodiment 1

Figure 8:
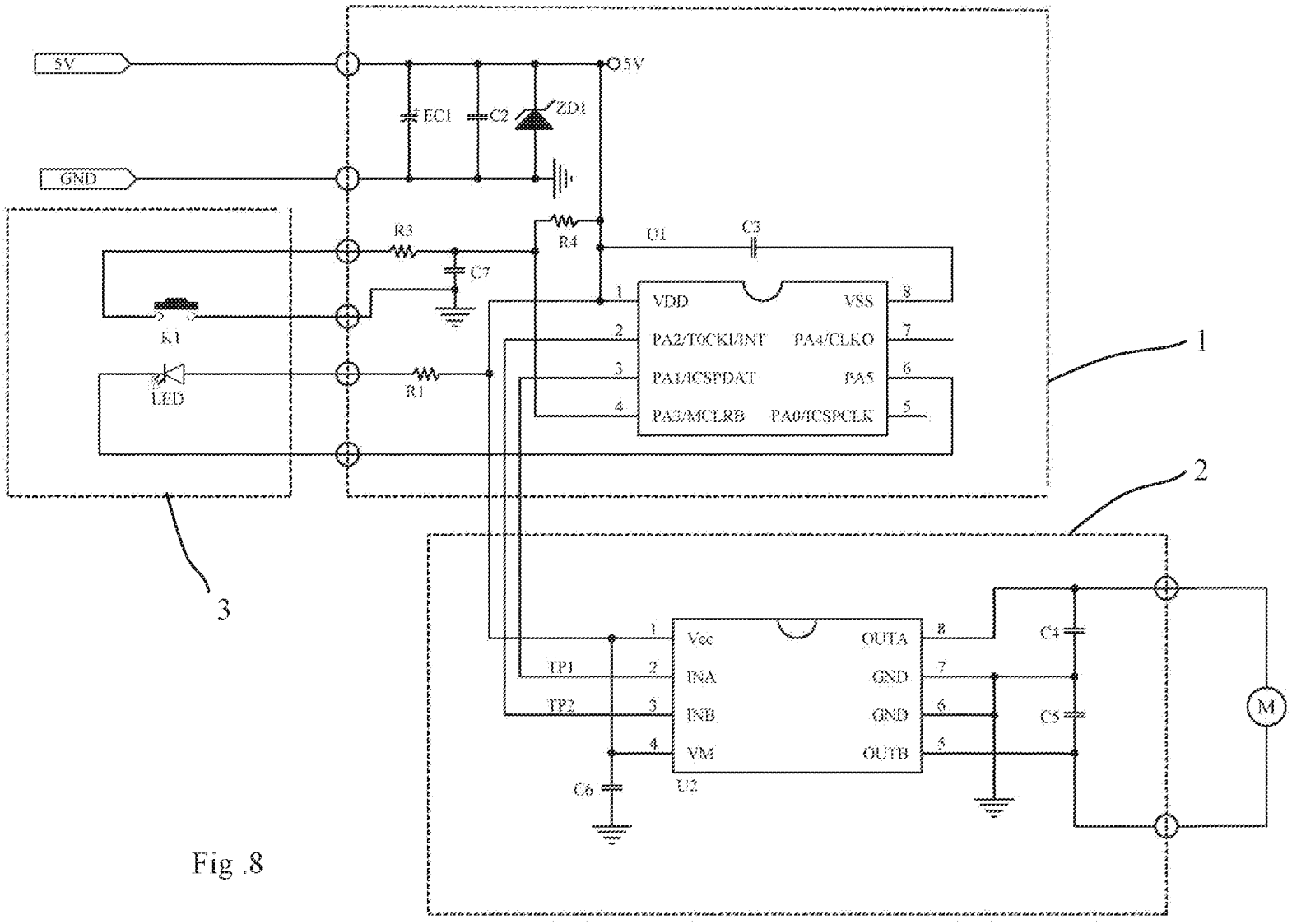
FIG. 8 is a circuit diagram of a circuit assembly for a submersible pump according to a first embodiment of the present application.

Referring to FIG. 8, in a first embodiment, the DC signal input in the figure is 5V, and the current is 1A. M represents the stator coil of the submersible pump. The signal generating circuit 1 is composed of the MCU and its peripheral components. As shown in the figure, the chip U1 is the MCU, and the model of the chip U1 is FT60F011A. The driving circuit 2 is composed of a MOS tube and peripheral components. As shown in the figure, the chip U2 is the MOS tube, and the model of the chip U2 is TC118S. The circuit 3 in the figure represents the prompting circuit and the switching circuit. The switching circuit includes a switch K1, and the prompting circuit includes a LED. Different working states of the submersible pump can be indicated by controlling the LED on, off, and blinking, such as the LED on, Off indicates that the submersible pump works and stops working.

A power supply pin VDD and a ground pin VSS of U1 are respectively connected to a positive pole and a negative pole of the DC power supply which is filtered by an electrolytic capacitor EC1. Capacity range of the electrolytic capacitor is preferably 100 uF-2200 uF. The power supply pin VDD and the ground pin VSS of U1 are also connected to a voltage regulator ZD1. Pin 4 PA3 of U1 is connected to a first switch, Pin 6 PA5 of the MCU is connected to the LED, Pin 2 PA2 and Pin 3 PA1 of U1 are output pins of the AC signal, and the Pin 2 PA2 and the Pin 3 PA1 are respectively connected to Pin 3 INB and Pin 2 INA of the chip U2.

The chip U1 plays a role of logic control in the circuit, and also functions as a AC signal generating circuit. The chip U1 receives control from the switch K1, and can turn on or turn off the indicator LED to indicate whether the submersible pump is working. At the same time, the chip U1 can also generate an AC signal. The AC signal is output from Pin 2 PA2 and Pin 3 PA1 of the chip U1 to the chip U2. The chip U2 receives the AC signal output by the chip U1, and provide enough drive current which is output from Pin 8 OUTA, Pin 5 OUTB to the stator coil, then the stator coil generates a rotating AC magnetic field which drives a rotor of the submersible pump running.

Embodiment 2

Figure 9:
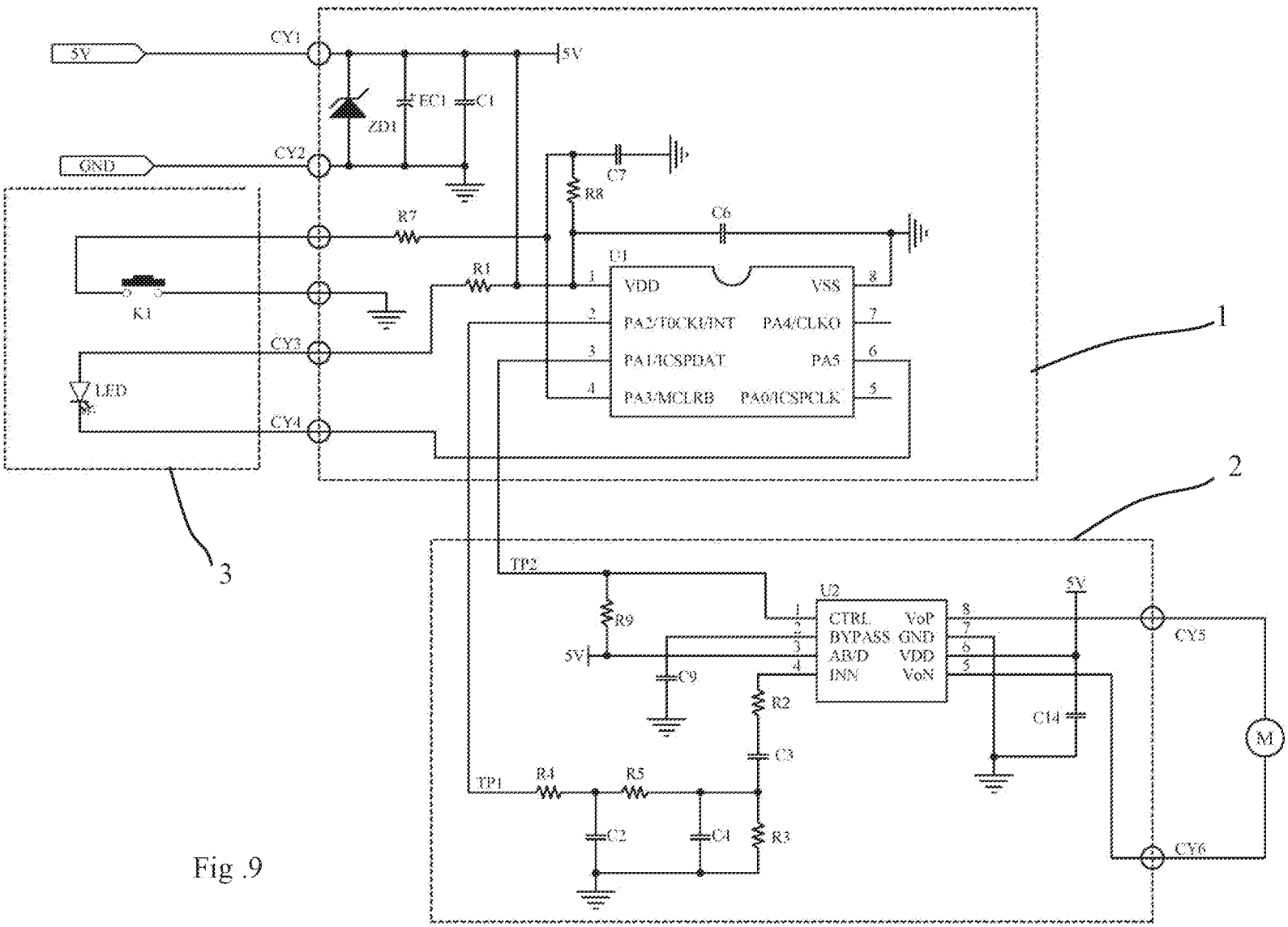
FIG. 9 is a circuit diagram of a circuit assembly for a submersible pump according to a second embodiment of the present application.

Referring to FIG. 9, a difference between this embodiment and the first embodiment shown in FIG. 8 is that the driving circuit 2 is composed of a digital power amplifier chip and its peripheral components. As shown in FIG. 9, the chip U2 is the digital power amplifier chip, and the model of the chip U2 is TC8871. The working principle of this embodiment is similar to that of Embodiment 1, and will not be repeated here.

Embodiment 3

Figure 10:
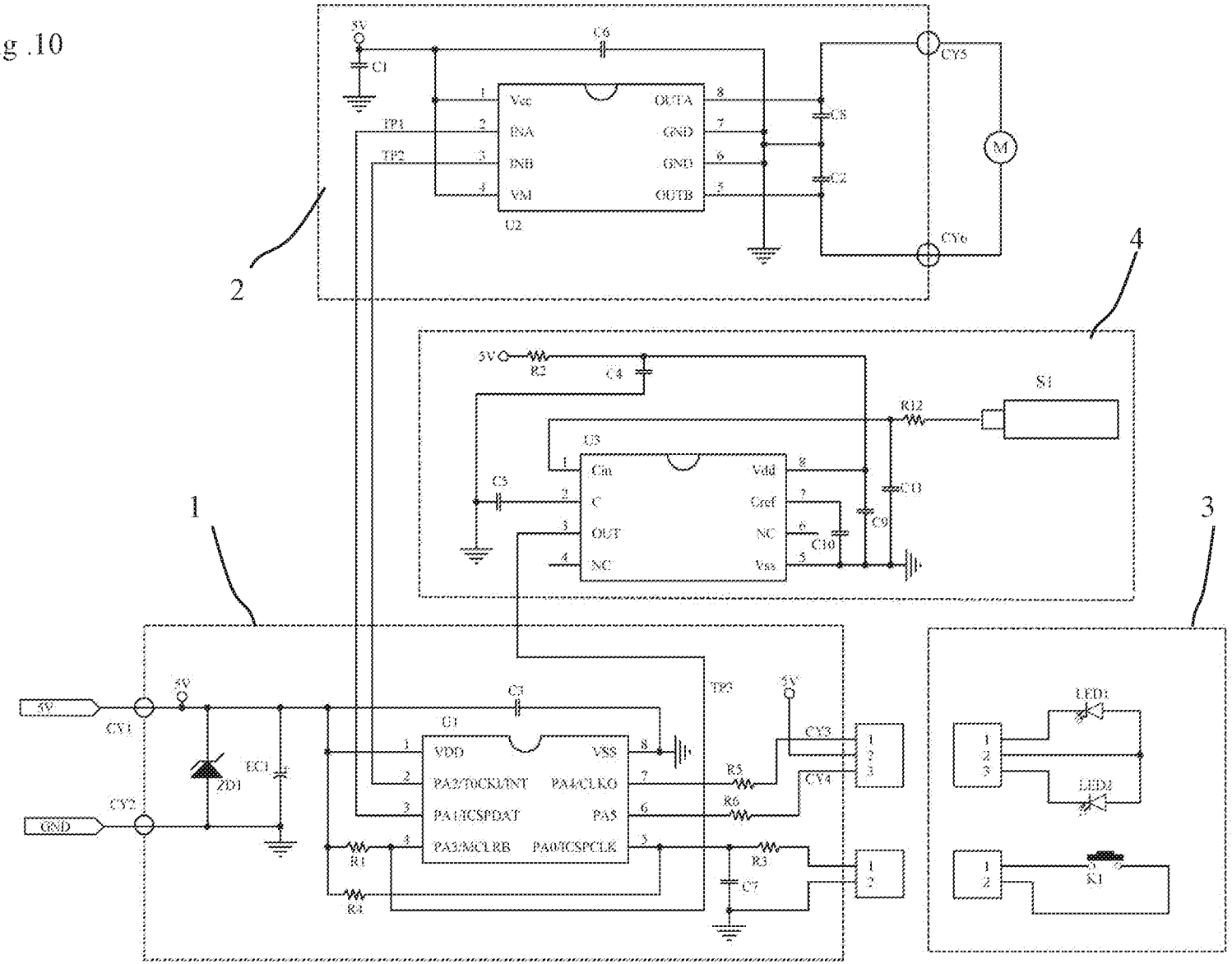
FIG. 10 is a circuit diagram of a circuit assembly for a submersible pump according to a third embodiment of the present application.

Referring to FIG. 10, a difference between this embodiment and the first embodiment as shown in FIG. 8 is that a water shortage detecting circuit 4 is added, wherein S1 is a liquid level detecting probe, and a LED for indicating the water level is also added. Specifically, the prompting circuit includes two LEDs LED1 and LED2, wherein the LED LED1 is a work indicator and also functions as landscape lighting, and the LED LED2 is used for water shortage prompt. Of course, actually only one LED is needed to achieve the above two functions. For example, a continuous lighting of the LED can be used to indicate a work state and landscape lighting, and a flashing of the LED can be used to indicate water shortage.

In this embodiment, the water shortage detecting circuit 4 is composed of a liquid level detection chip U3 and peripheral components, and the model of the chip U3 is HL-2205S. When the probe is submerged in water, the chip U3 provides a signal representing having water to the chip U1 through Pin 3. When the probe is not submerged in water, the chip U3 provides a liquid level protection signal representing no water to the chip U1 through Pin 3. The chip U1 can receive the liquid level protection signal (TP3) provided by the water shortage detecting circuit 4, and control on/off of the indicator LED2, prompting the user that the liquid level is too low, and cut off the AC signal provided to the chip U2 when the liquid level is too much low. The submersible pump stopped.

Embodiment 4

Figure 11:
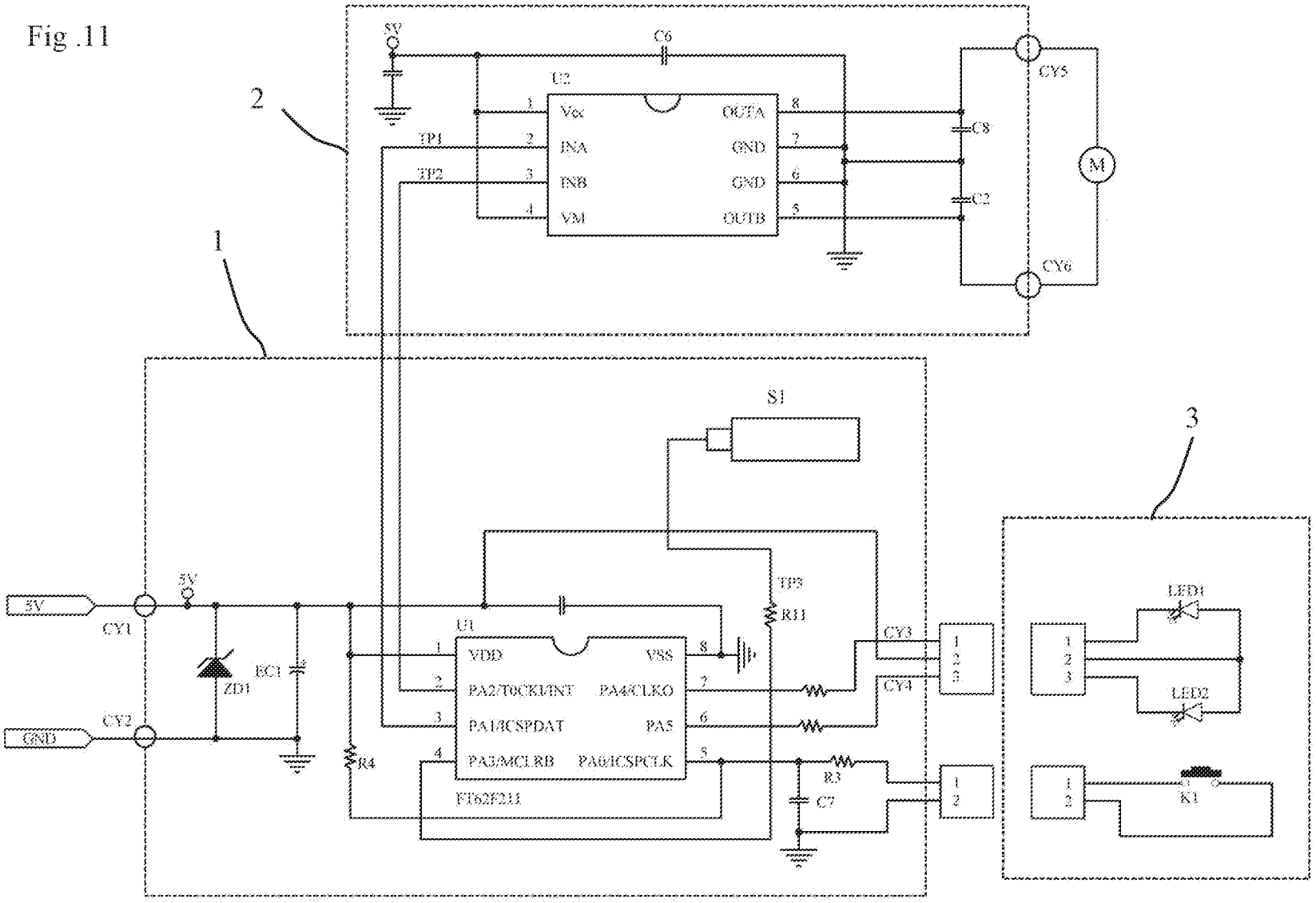
FIG. 11 is a circuit diagram of a circuit assembly for a submersible pump according to a fourth embodiment of the present application.

Referring to FIG. 11, a difference between this embodiment and Embodiment 3 is mainly that the signal of the probe is directly pulled to the MCU, and the MCU implements the liquid level protection function according to the signal of the probe.

Embodiment 5

Figure 12:
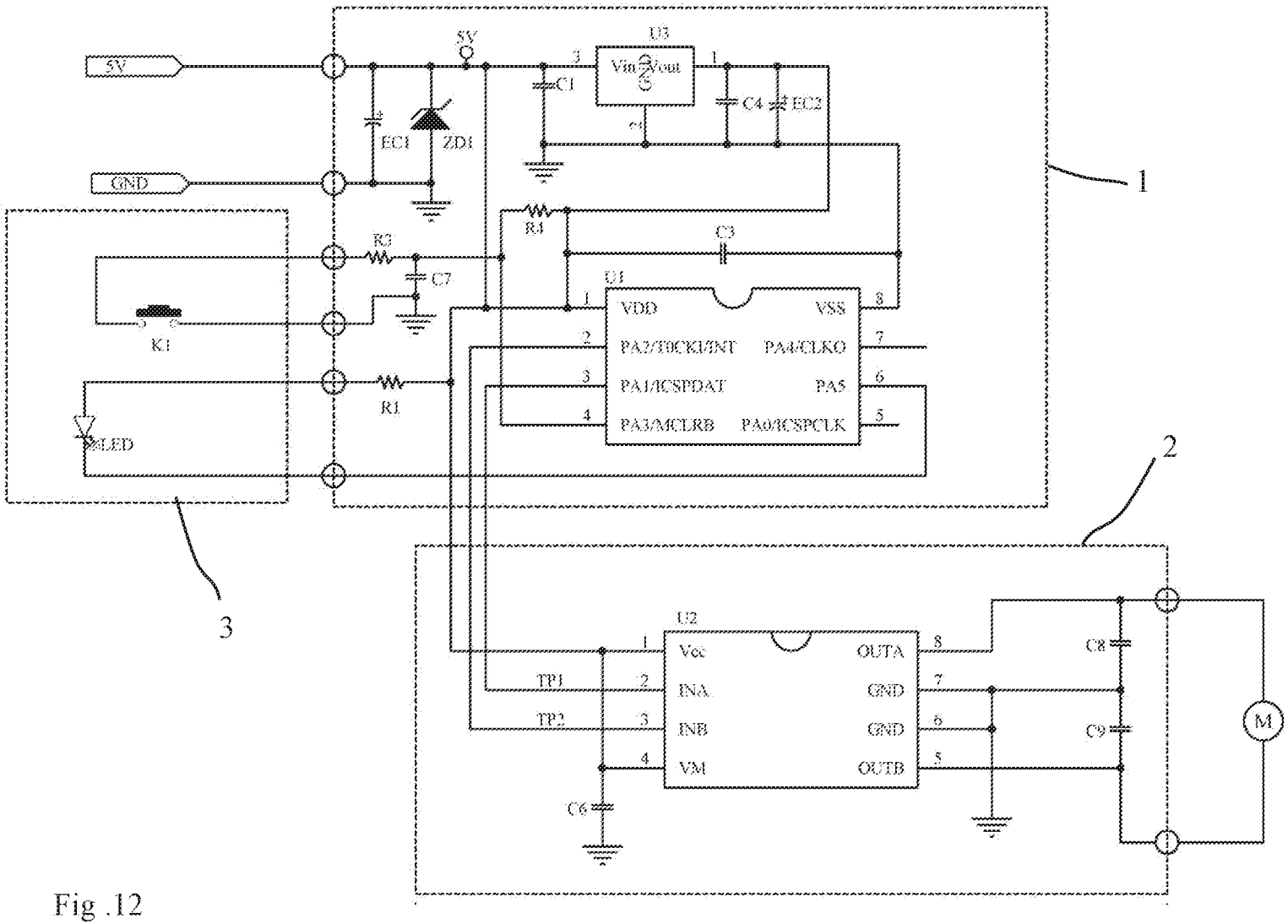
FIG. 12 is a circuit diagram of a circuit assembly for a submersible pump according to a fifth embodiment of the present application.

Referring to FIG. 12, a difference between this embodiment and the first embodiment is mainly that the input of the signal generating circuit 1 is connected to a three-terminal voltage stabilizing chip U3 and its peripheral circuits, and the model of the chip U3 is HT7533. The chip U3 can ensure the stability of the DC signal input to the signal generating circuit 1.

Embodiment 6

Figure 13:
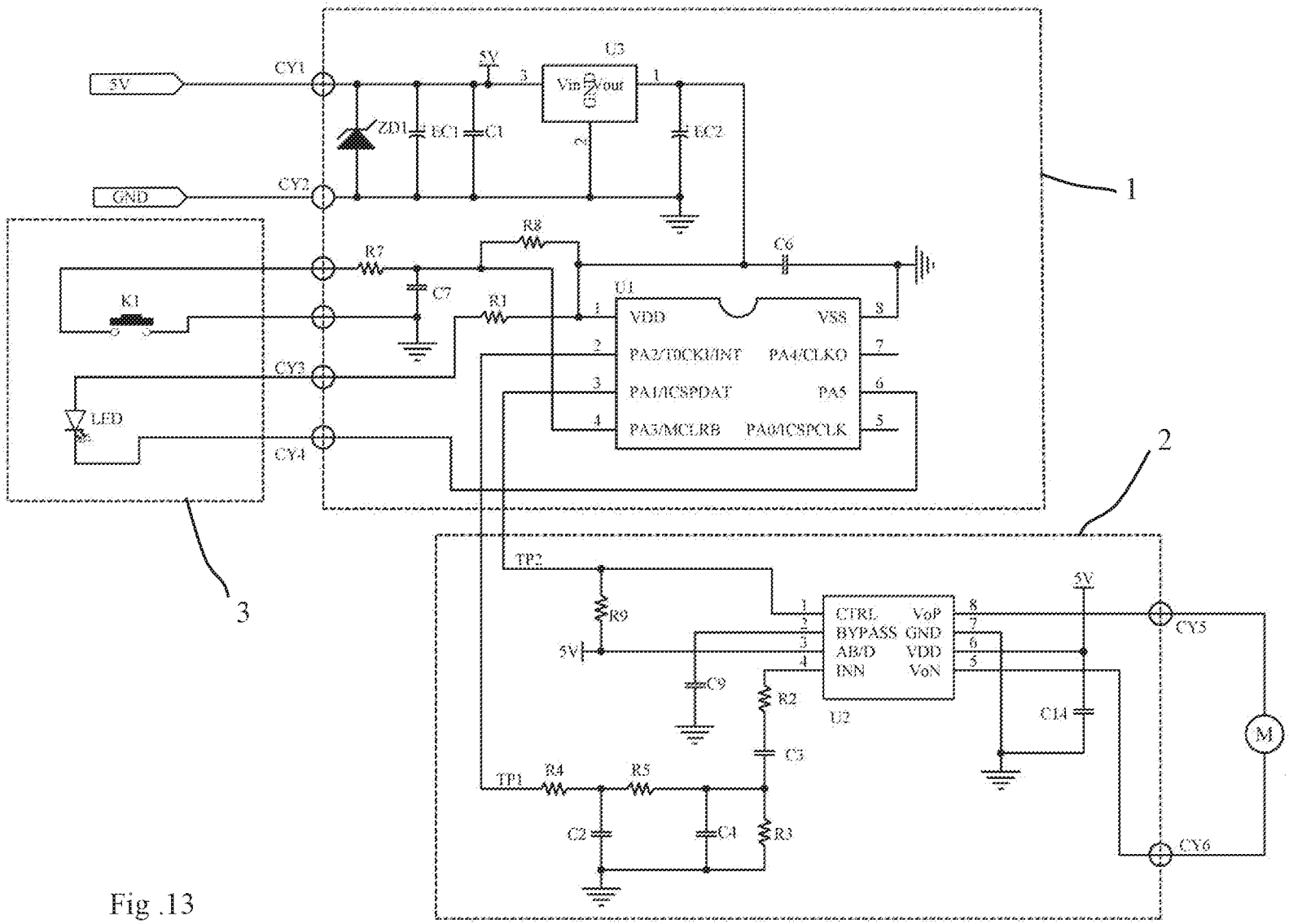
FIG. 13 is a circuit diagram of a circuit assembly for a submersible pump according to a sixth embodiment of the present application.

Referring to FIG. 13, a difference between this embodiment and the second embodiment is mainly that the input of the signal generating circuit 1 is connected to a three-terminal voltage stabilizing chip U3 and its peripheral circuits. The model of the chip U3 is HT7533. The chip U3 can ensure the stability of the DC signal input to the signal generating circuit 1.

Embodiment 7

Figure 14:
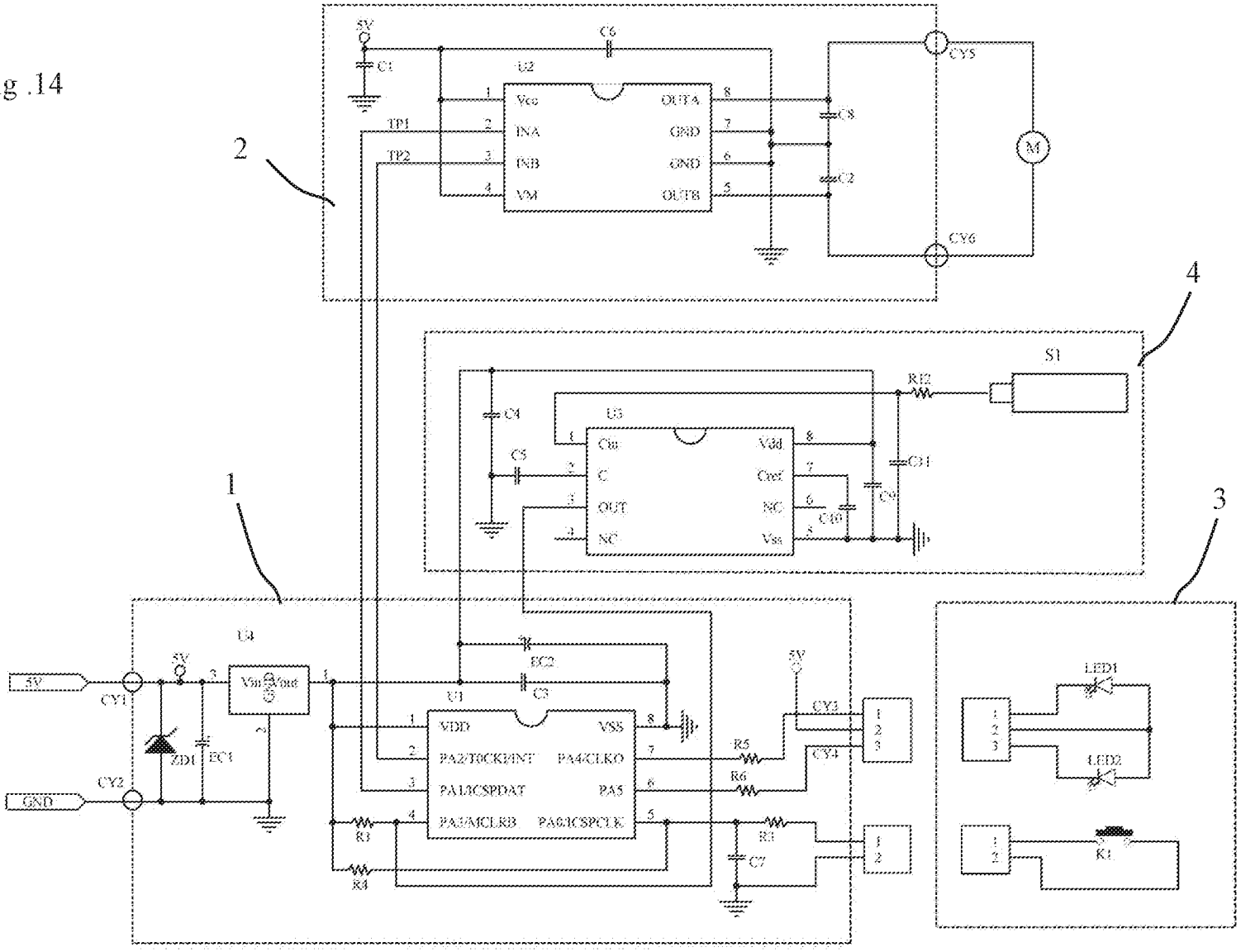
FIG. 14 is a circuit diagram of a circuit assembly for a submersible pump according to a seventh embodiment of the present application.

Referring to FIG. 14, a difference between this embodiment and the third embodiment is mainly that the input of the signal generating circuit 1 is connected to a three-terminal voltage stabilizing chip U4 and its peripheral circuits. The model of the chip U4 is HT7533. The chip U4 can ensure the stability of the direct current signal input to the signal generating circuit 1.

Embodiment 8

Figure 15:
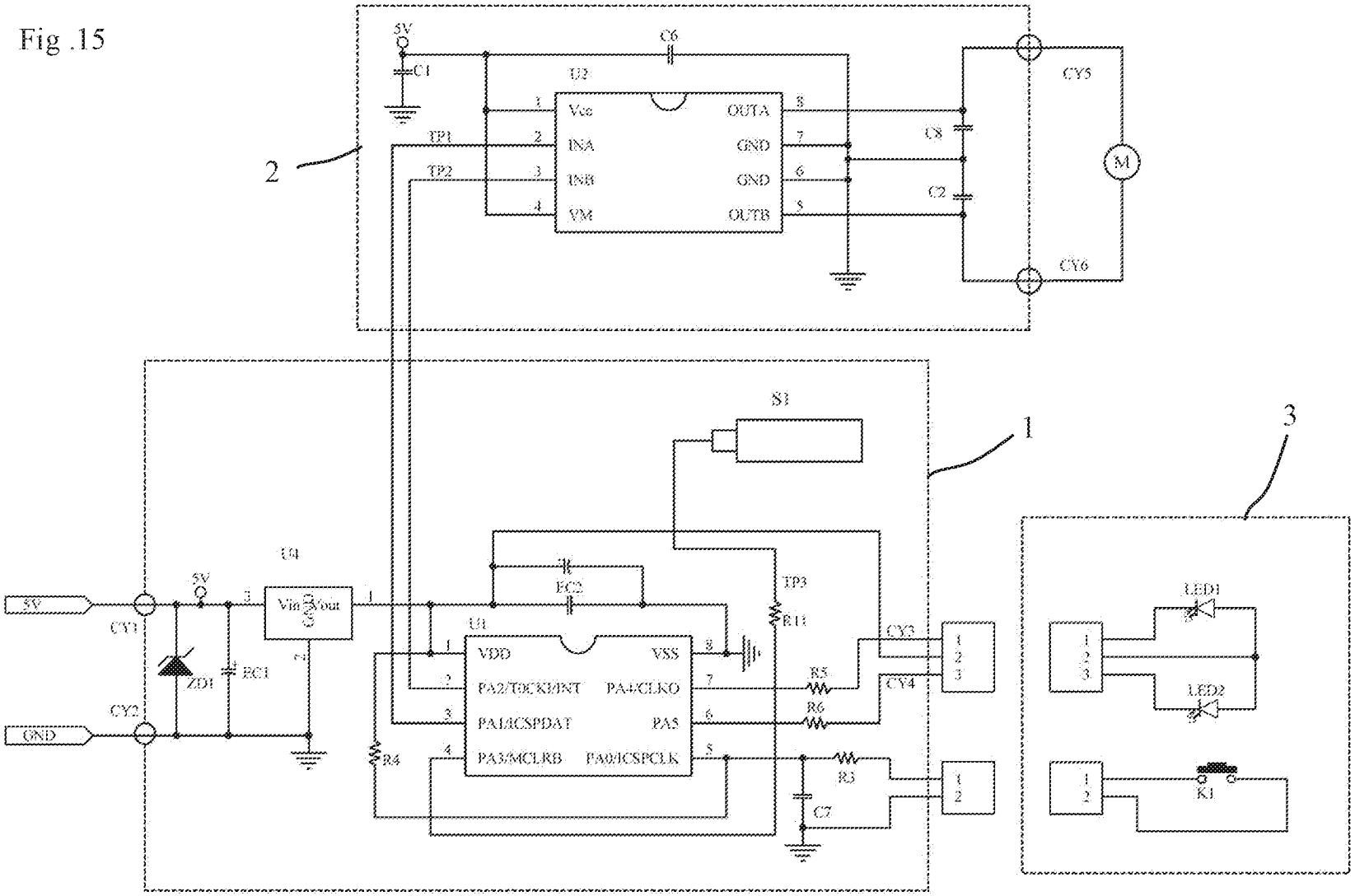
FIG. 15 is a circuit diagram of a circuit assembly for a submersible pump according to an eighth embodiment of the present application.

Referring to FIG. 15, a difference between this embodiment and the Embodiment 4 is mainly that the input of the signal generating circuit 1 is connected to a three-terminal voltage stabilizing chip U4 and its peripheral circuits, and the model of the chip U4 is HT7533. The chip U4 can ensure the stability of the direct current signal input to the signal generating circuit 1.

It should be noted that selection of components in the above embodiments is only an example and is not intended to limit protection scope of the present application.

Figure 16:
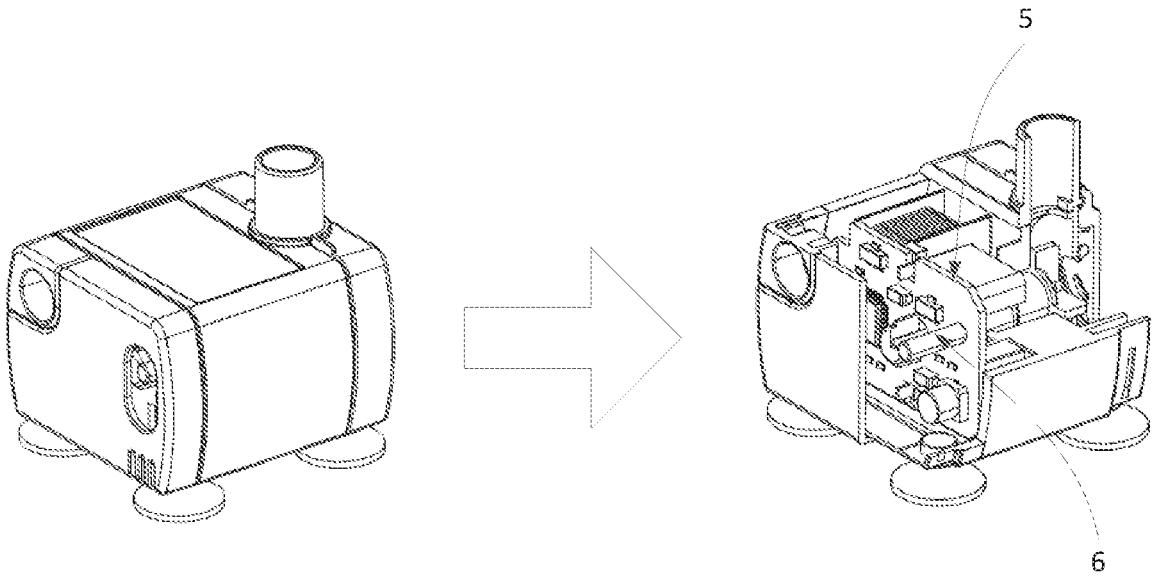
FIG. 16 is a structural comparison diagram showing assembly and disassembly of a submersible pump according to an embodiment of the present application.
Figure 17:
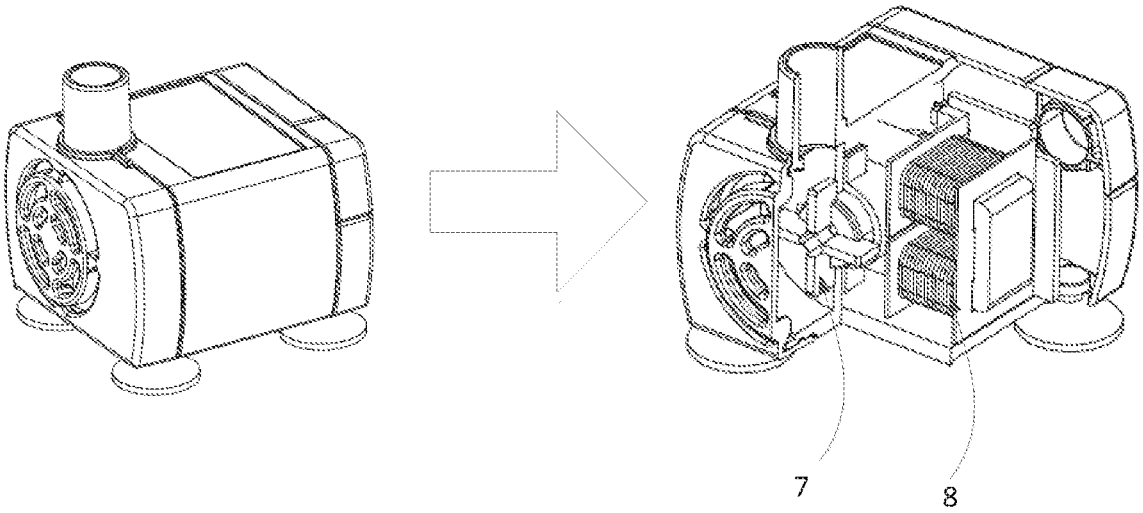
FIG. 17 is a structural comparison diagram showing assembly and disassembly of the submersible pump according to an embodiment of the present application.
Figure 18:
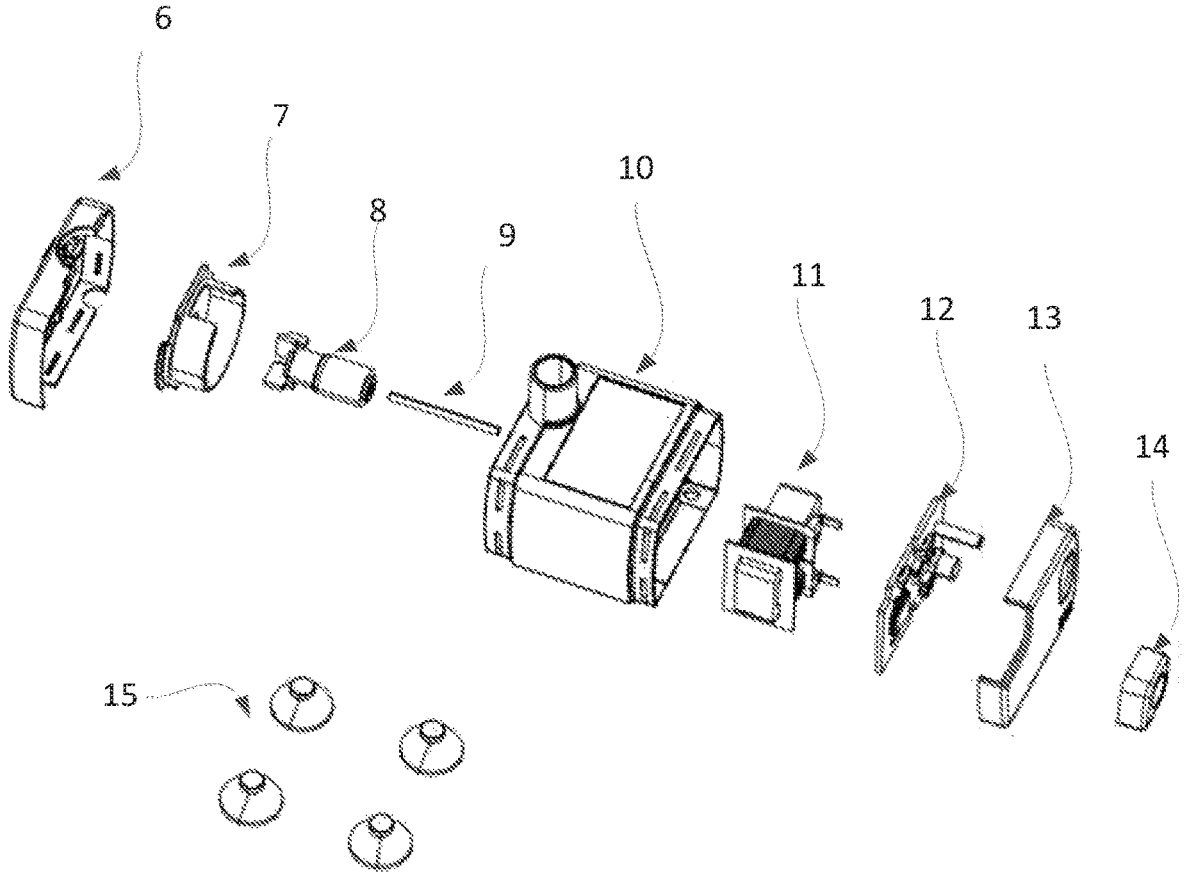
FIG. 18 is an exploded view of a submersible pump according to an embodiment of the present application.

As shown in FIGS. 16-18, the submersible pump using the above circuit assembly mainly includes a front cover 6, a blade-housing cover 7, a rotor 8, a stainless steel shaft 9, a pump housing 10, a stator coil 11, a circuit board 12, a rear cover 13, a wire penetrating buckle 14 and suction cups 15 used to realize fixation of the entire pump housing 10. The stator coil 11 is driven by the circuit assembly of the submersible pump described above.

Figure 19:
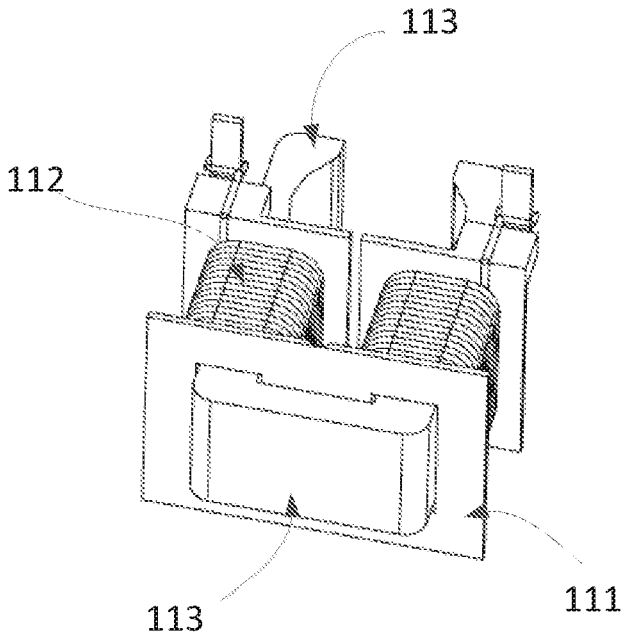
FIG. 19 is a structural schematic diagram of a stator coil according to an embodiment of the present application.
Figure 20:
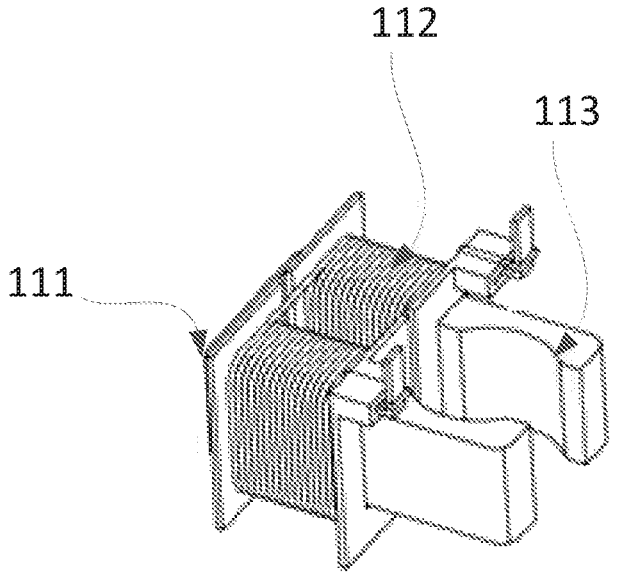
FIG. 20 is a structural schematic diagram of the stator coil according to an embodiment of the present application.

Referring to FIGS. 19-20, the stator coil 11 comprises a plastic frame 111, an enameled copper wire 112 wound on the plastic frame 111, and a stator metal core 113 inserted in the plastic frame 111 wrapped with the enameled copper wire 112. Specifically, wire diameter of the enameled copper wire 112 is 0.1 mm-0.4 mm. Number of coil turns of the enameled copper wire 112 wound on the plastic frame 111 is 100-400 turns. The enameled copper wire 112 wound on the plastic frame 111 is formed by winding one enameled copper wire 112 or a plurality of enameled copper wires 112 in parallel. The stator metal core 113 is U-shaped, which is composed of a plurality of U-shaped metal sheets with a thickness of 0.3 mm-0.8 mm laminated together.

In summary, the circuit assembly for a submersible pump and the submersible pump using the same according embodiments of the present application have the following beneficial effects: the submersible pump of the present application can directly access DC power supply, which is very convenient for the user; and further, the water shortage detecting circuit can be preferably configured to trigger the signal generating circuit to control the driving circuit stopping driving the stator coil when the liquid level is too low, so that water pumping is no longer continued, and a protection when the water level is too low is realized.

The embodiments of the present application have been described above with reference to the drawings, but the present application is not limited to the specific embodiments described above, and the specific embodiments described above are merely illustrative and not restrictive. In the light of the scope of the present application, many forms may be made without departing from the scope of the present application, and these are all within protection of the present application.

What is claimed is:

1. A circuit assembly for a submersible pump, comprising:

a signal generating circuit, which is configured to access a DC signal having a voltage range of 3V-24V, and invert the DC signal into an AC signal having a frequency range of 40 Hz-200 Hz and then output the AC signal;

a driving circuit, which has an input terminal connected to the signal generating circuit and an output terminal connected to a stator coil of the submersible pump, and is configured to receive the AC signal and drive the stator coil to work;

a water shortage detecting circuit, which is connected to the signal generating circuit, and is configured to monitor liquid level based on a detection signal of a liquid level detecting probe, and trigger the signal generating circuit to control the driving circuit when the liquid level is detected to be lower than the liquid level detecting probe, causing the driving circuit stop supplying power to the stator coil, so that the submersible pump stops pumping;

a switching circuit, which is connected to the signal generating circuit, and is configured to acquire a switching signal input by a user and output the switching signal to the signal generating circuit, to trigger the signal generating circuit to control the driving circuit to change operating mode, or to control start or shutdown of the driving circuit; and a prompting circuit, which is connected to the signal generating circuit, and is configured to prompt working status of the submersible pump by controlling working status of a LED.

2. The circuit assembly for a submersible pump of claim 1, wherein the signal generating circuit is composed of a 555 chip and its peripheral components, or is composed of a digital gate integrated chip and its peripheral components, or the signal generating circuit is composed of a triode and resistors, capacitors, or the signal generating circuit is composed of a MCU and its peripheral components.

3. The circuit assembly for a submersible pump of claim 1, wherein the driving circuit is composed of a motor-specific driver chip and its peripheral components, or a MOSFET tube and its peripheral components, or a digital power amplifier chip and its peripheral components, or a triode and resistors, capacitors.

4. The circuit assembly for a submersible pump of claim 1, wherein the AC signal is a square wave signal, or a sine wave signal, or a modified sine wave signal, or a triangular wave signal, or a truncated sine wave signal, or a trapezoidal wave signal.

5. The circuit assembly for a submersible pump of claim 1, wherein the frequency range of the AC signal is 40 Hz-80 Hz.

6. The circuit assembly for a submersible pump of claim 1, wherein the liquid level detecting probe is made of metal or carbon fiber.

7. The circuit assembly for a submersible pump of claim 1, wherein the water shortage detecting circuit is composed of a liquid level detection chip of model HL-2205S and its peripheral components, or a MCU and its peripheral components, or a touch sensor chip and its peripheral components, or a triode and resistors, capacitors.

8. The circuit assembly for a submersible pump of claim 1, wherein the liquid level detecting probe is welded on a circuit board or fixed on a circuit board with screws.

9. The circuit assembly for a submersible pump of claim 2, wherein a model of the MCU is FT60F011A, and a power supply pin and a ground pin of the MCU are connected to a positive pole and a negative pole of a DC power supply which is filtered by an electrolytic capacitor respectively, and a Pin 4 of the MCU is connected to a first switch, Pin 6 and Pin 7 of the MCU are respectively connected to a first LED and a second LED, and Pin 2 and Pin 3 of the MCU are output pins of the AC signal.

10. The circuit assembly for a submersible pump of claim 9, wherein capacity range of the electrolytic capacitor is 100 uF-2200 uF.

11. A submersible pump, comprising a circuit assembly, wherein the circuit assembly comprises:

a signal generating circuit, which is configured to access a DC signal having a voltage range of 3V-24V, and invert the DC signal into an AC signal having a frequency range of 40 Hz-200 Hz and then output the AC signal; and a driving circuit, which has an input terminal connected to the signal generating circuit and an output terminal connected to a stator coil of the submersible pump, and is configured to receive the AC signal and drive the stator coil to work;

a water shortage detecting circuit, which is connected to the signal generating circuit, and is configured to monitor liquid level based on a detection signal of a liquid level detecting probe, and trigger the signal generating circuit to control the driving circuit when the liquid level is detected to be lower than the liquid level detecting probe, causing the driving circuit stop supplying power to the stator coil, so that the submersible pump stops pumping;

a switching circuit, which is connected to the signal generating circuit, and is configured to acquire a switching signal input by a user and output the switching signal to the signal generating circuit, to trigger the signal generating circuit to control the driving circuit to change operating mode, or to control start or shutdown of the driving circuit; and a prompting circuit, which is connected to the signal generating circuit, and is configured to prompt working status of the submersible pump by controlling working status of a LED.

12. The submersible pump of claim 11, wherein the frequency range of the AC signal is 40 Hz-80 Hz.

13. The submersible pump of claim 11, wherein the stator coil comprises a plastic frame, an enameled copper wire wound on the plastic frame, and a stator metal core inserted in the plastic frame that has been wrapped with the enameled copper wire.

14. The submersible pump of claim 13, wherein wire diameter of the enameled copper wire is 0.1 mm-0.4 mm.

15. The submersible pump of claim 13, wherein number of coil turns of the enameled copper wire wound on the plastic frame is 100-400 turns.

16. The submersible pump of claim 13, wherein the enameled copper wire wound on the plastic frame is formed by winding one enameled copper wire or a plurality of enameled copper wires in parallel.

17. The submersible pump of claim 13, wherein the stator metal core comprises a plurality of U-shaped metal sheets with a thickness of 0.3 mm-0.8 mm laminated together.

* * * * *